US005367740A

United States Patent [19]

McCray

[11] Patent Number: 5,367,740

[45] Date of Patent: Nov. 29, 1994

[54] HAND-HELD SURFACE CLEANING APPARATUS

[76] Inventor: Kimothy R. McCray, 1925 College Ave., Apt 188, San Bernardino, Calif. 92407

[21] Appl. No.: 96,012

[22] Filed: Jul. 21, 1993

[51] Int. Cl.[5] ..... A47L 5/26

[52] U.S. Cl. ..... 15/320; 15/344; 15/353; 15/385

[58] Field of Search ..... 15/320, 344, 385, 353, 15/321, 322

[56] References Cited

U.S. PATENT DOCUMENTS

| | | | |
|---|---|---|---|
| 2,588,000 | 3/1952 | Hines | 15/385 X R |
| 3,871,051 | 3/1975 | Collier | 15/321 |
| 3,939,527 | 2/1976 | Jones . | |
| 4,156,952 | 6/1979 | Lynch, Jr. . | |
| 4,353,145 | 12/1982 | Woodford | 15/321 |
| 4,788,738 | 12/1988 | Monson et al. . | |
| 4,798,613 | 1/1989 | Hetherington et al. | 15/344 X R |
| 4,930,178 | 6/1990 | Monson et al. . | |
| 4,951,346 | 8/1990 | Salmon | 15/322 |
| 5,056,186 | 10/1991 | Jiam-Fa | 15/344 X R |
| 5,099,545 | 3/1992 | Krasznai et al. . | |

*Primary Examiner*—Chris K. Moore
*Attorney, Agent, or Firm*—Sheldon & Mak

[57] ABSTRACT

Disclosed is a portable cleaner apparatus for cleaning a workpiece surface. The apparatus includes a housing having a suction opening at a nozzle extremity, a suction passage in the housing terminating at the suction opening; and a motor driven brush rotatably supported relative to the housing and axially projecting beyond the nozzle extremity for selective engagement of desired circumferential portions of the brush with the workpiece surface; a vacuum pump for drawing unwanted material into the suction passage through the suction opening. A supply container holds a cleaning fluid and is releasably held fluid connected to a supply passage by a supply support. At least one fluid delivery passage having a fluid outlet proximate the suction opening selectively applies the cleaning fluid to the workpiece surface. A pressure pump fluid connected to the supply means for selectively feeds the cleaning fluid through the delivery passage and from the fluid outlet. A collector for receiving unwanted material from the suction passage includes a receiver passage connected to the suction passage; a receiver support for releasably supporting a receiver container that is fluid connected to the receiver passage and fluid connected to the vacuum pump; and a separator for preventing the unwanted material from passing to the vacuum pump from the receiver passage. The apparatus can include a handle for manually manipulating the apparatus, and a feed control for selectively feeding the cleaning fluid.

10 Claims, 1 Drawing Sheet

HAND-HELD SURFACE CLEANING APPARATUS

BACKGROUND

The present invention relates to carpet cleaning, and more particularly to devices for cleaning upholstery and other surfaces in difficult to access locations such as vehicles and the like.

Portable vacuum cleaners that are adapted for use on stairs, vehicles, and in similar locations are known in the prior art. Also known are the use of surface cleaning fluids and subsequently recovering same by vacuum. U.S. Pat. No. 4,156,952 to Lynch, Jr., discloses a carpet soil extractor having a reciprocally powered brush in combination with a vacuum head and solution ejecting nozzles, the extractor being supported on a carpet solely by a mouth of the vacuum head, the brush and a spring skid, brush pressure being variable in response to tilting of the extractor.

The surface cleaners of the prior art nevertheless exhibit a number of disadvantages. For example:

1. They are ineffective in that they do not include brushes.

2. They are ineffective for use in confined areas such as are encountered in vehicles. In particular, the extractor of Lynch, Jr., is required to contact the surface to be cleaned over a large area and to be moved gross distances while maintaining the large area contact.

3. They are difficult to use in that they are awkward to service.

4. They are expensive to produce in that they have complex reciprocating brush mechanisms.

Thus there is a need for a compact portable surface cleaner that is effective and convenient to use in confined spaces such as vehicle interiors.

SUMMARY

The present invention meets this need by providing a fluid dispensing and collecting hand-held vacuum cleaner apparatus having a rotary powered brush that is usable for producing scrubbing action in desired directions relative to the apparatus. In one aspect of the invention, the apparatus includes a housing having a suction opening at a nozzle extremity, a suction passage in the housing terminating at the suction opening; a motor driven brush member rotatably supported relative to the housing and axially projecting beyond the nozzle extremity for selective engagement of desired circumferential portions of the brush member with the workpiece surface; a vacuum pump for drawing unwanted material into the suction passage through the suction opening; supply means for holding a cleaning fluid; a pressure pump fluid connected to the supply means; at least one fluid delivery passage having a fluid outlet proximate the suction opening for selectively applying the cleaning fluid to a workpiece surface; and collector means for receiving the unwanted material from the suction passage.

The supply means can include a supply passage fluid connected to the delivery passage, and a supply support for releasably holding a supply container fluid connected to the supply passage, the cleaning fluid being delivered through the supply passage to the delivery passage. The apparatus can include the supply container.

The collector means can include a receiver passage connected to the suction passage, a receiver support for releasably supporting a receiver container fluid connected to the receiver passage for receiving the unwanted material, means for fluid connecting the vacuum pump to the receiver container, and a separator for preventing the unwanted material from passing to the vacuum pump from the receiver passage. The apparatus can include receiver container.

Preferably the apparatus includes a flexible power cord for connecting to a vehicle electrical power outlet for powering the motor drive. A handle member is preferably rigidly supported relative to the housing for manually manipulating the apparatus. The apparatus preferably includes feed control for selectively feeding the cleaning fluid. The apparatus can include a brush control for selectively activating rotation of the brush member.

DRAWINGS

These and other features, aspects, and advantages of the present invention will become better understood with reference to the following description, appended claims, and accompanying drawings, where:

DESCRIPTION

Figure 1:
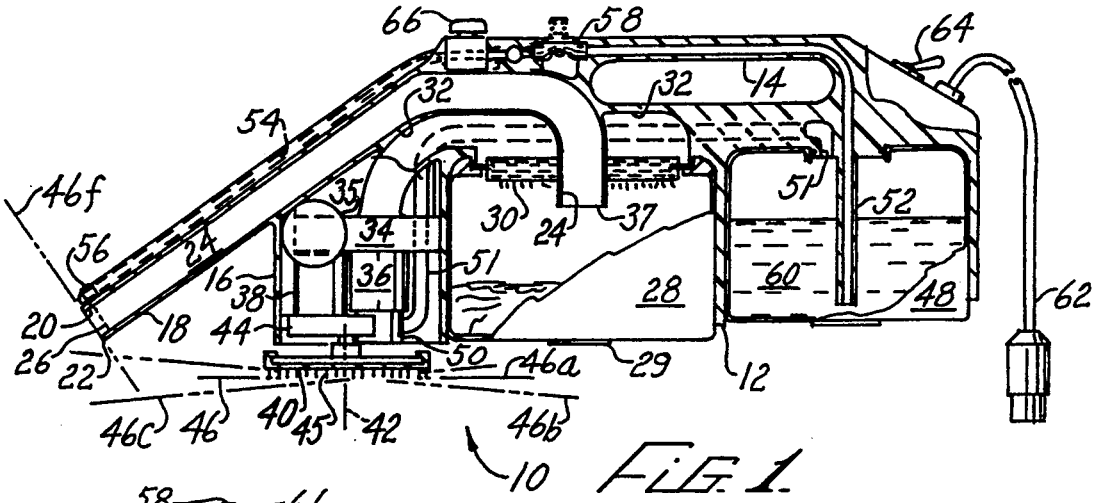
FIG. 1 is a fragmentary sectional side elevational view of a surface cleaning apparatus according to the present invention.
Figure 2:
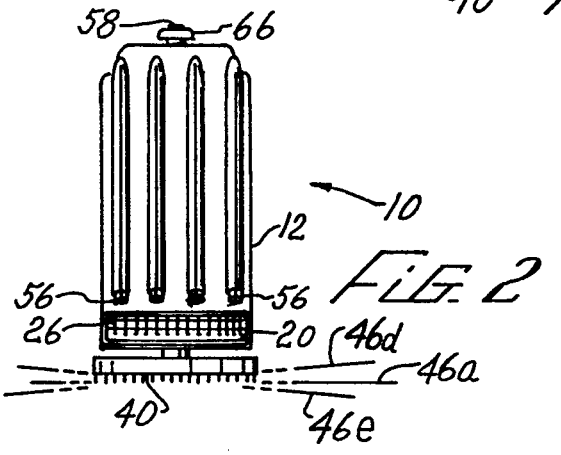
FIG. 2 is a front end elevational view of the apparatus of FIG. 1.

The present invention is directed to a hand-held fluid dispensing and collecting vacuum cleaner that is particularly effective, inexpensive and easy to use. With reference to FIGS. 1 and 2 of the drawings, a carpet cleaner apparatus 10 according to the present invention includes a housing 12 having a horizontally disposed handle portion 14, a body portion 16, and a downwardly sloping nozzle portion 18 having a suction opening 20 at a nozzle extremity 22 of the nozzle portion 18. A suction passage 24 extends within the housing 12, and the suction opening 20 is provided with a screen 26 for excluding large objects from the suction passage 24.

A collection tank 28 is removably supported by the housing 12 by a latch member 29 for receiving waste material from the suction passage 24, an upper portion of the collection tank 28 being sealingly fluid connected through a separator 30 to a vacuum passage 32 of a vacuum pump 34, the suction passage 24 sealingly extending through the separator 30 into the tank 28. The vacuum pump 34, which also has an exhaust port 35, is powered by an electric pump motor 36. Thus in the exemplary configuration of the apparatus 10 that is shown in the drawings, the vacuum pump 34 is fluid connected to the suction passage 24 through the separator 30 and the collection tank 28, the tank 28 being sealingly connected to the separator 30 and covering an outlet 37 of the suction passage 24. While any relatively high volume vacuum pump is suitable for use as the vacuum pump 34, a preferred implementation of the pump 34 has a high-speed centrifugal impeller (not shown) that is directly coupled to a rotor of the pump motor 36. As further shown in FIG. 1, the separator 30 is removably supported by the collection tank 28 for facilitating cleaning or replacement of the separator 30.

A drive motor 38 is operatively coupled to a brush member 40 that is rotatably supported relative to the housing 12 on a nominally vertical brush axis 42, it being understood that the brush axis 42 is approximately vertical when the apparatus 10 is oriented as shown in FIGS. 1 and 2 of the drawings. The brush member 40 is preferably driven at low or medium speed by being coupled to the drive motor 38 through a reduction gear drive 44. Further, the brush member 40 preferably extends vertically below the housing 12 and particularly the nozzle extremity 22 thereof, for advantageously permitting full or partial contact between the brush member 40 and a workpiece surface 46 as further described below. Preferably the brush member 40 has soft bristles or other protrusions 45 thereon for agitating carpet piles and the like that form the workpiece surface 46 without damage thereto.

The apparatus 10 also includes a solution tank 48 that is removably connected to the housing 12 by a counterpart of the latch member 29, the solution tank 48 being pressurized by a pressure pump 50 that is powered by the pump motor 36, the pump 50 being fluid connected to the tank 48 by a pressure conduit 51. A tubular feed line 52 extends into the solution tank 48 and is fluid connected to at least one dispenser conduit 54 for dispensing the fluid from proximate the suction opening 20, there being preferably a spaced plurality of the dispenser conduits 54 as shown in FIG. 2, each dispenser conduit 54 being terminated by a spray nozzle 56. A momentary push button released pinch valve 58 is fluid connected in series with the feed line 52 for momentarily feeding cleaning fluid 60 from the solution tank 48 and spraying the fluid 60 from the nozzles 56 onto the workpiece surface 46.

The apparatus 10 further includes a flexible power cord 62 for powering the motors 36 and 38 from a suitable source such as a vehicle cigar lighter socket (not shown). The power cord 62 is connected in series with a main power switch 64 for activating the pump motor 36, a separate brush control switch 66 activating the drive motor 38 when the power switch 64 is also closed for selective operation of the brush member 40.

In use, the apparatus 10 is manipulated by the handle portion 14 for vacuuming debris from the workpiece surface 46 into the suction opening 20, the pinch valve 58 being opened when it is desired to spray the cleaning fluid 60 onto selected areas of the workpiece surface 46. With the control switch 66 activated, the workpiece surface 46 can be agitated by the brush member 40 for loosening adhering matter, thereby facilitating subsequent pick-up into the suction opening 20. According to the present invention, the brush member 40 provides multidirectional agitation of the workpiece surface 46. In particular, when the apparatus 10 is positioned in alignment with the workpiece surface 46 as indicated by the line **46*a* in FIG. 1 while being advanced along the workpiece surface 46, portions of the workpiece surface 46** are progressively agitated in a circular sequence.

When the apparatus 10 is inclined relative to the workpiece surface 46 as indicated by the line **46*b*, the agitation is in a first lateral direction; when the apparatus 10 is inclined relative to the workpiece surface 46 as indicated by the line 46*c***, the agitation is in an opposite second lateral direction.

When the apparatus 10 is inclined relative to the workpiece surface 46 as indicated by the line **46*d* in FIG. 2, the agitation is in a first longitudinal direction; when the apparatus 10 is inclined relative to the workpiece surface 46 as indicated by the line 46*e***, the agitation is in an opposite second longitudinal direction.

Thus the agitation by the brush member 48 can be in progressively controllable directions by suitably advancing the brush member 40 along the workpiece surface 46 while selectively orienting the housing 12 by means of the handle portion 14.

Advantageously, the nozzle extremity 22 is not required to contact the workpiece surface 46 during agitation by the brush member 40. Thus the cleaning fluid 60 is not prematurely vacuumed away into the suction opening 20, thereby conserving the fluid 60. While it is understood that it may be convenient to have contact between the nozzle extremity 22 when the orientation is generally as indicated by the line **46*c*, the suction opening 20 is not fully covered by the workpiece surface 46. Accordingly, an amount of the cleaning fluid 60 can be temporarily retained as desired on the workpiece surface 46. Alternatively, the orientation as indicated by the line 46*c* can be reserved to be subsequent to the other orientations that are used on a given area of the workpiece surface 46. When it is desired to vacuum substantially all of the cleaning fluid 60 from the workpiece surface together with such debris as may be present, the apparatus 10 is moved relative to the workpiece surface 46 as indicated by the line 46*f* in FIG. 1, whereby the suction opening 20 substantially fully engages the workpiece surface 46**.

Figure 3:
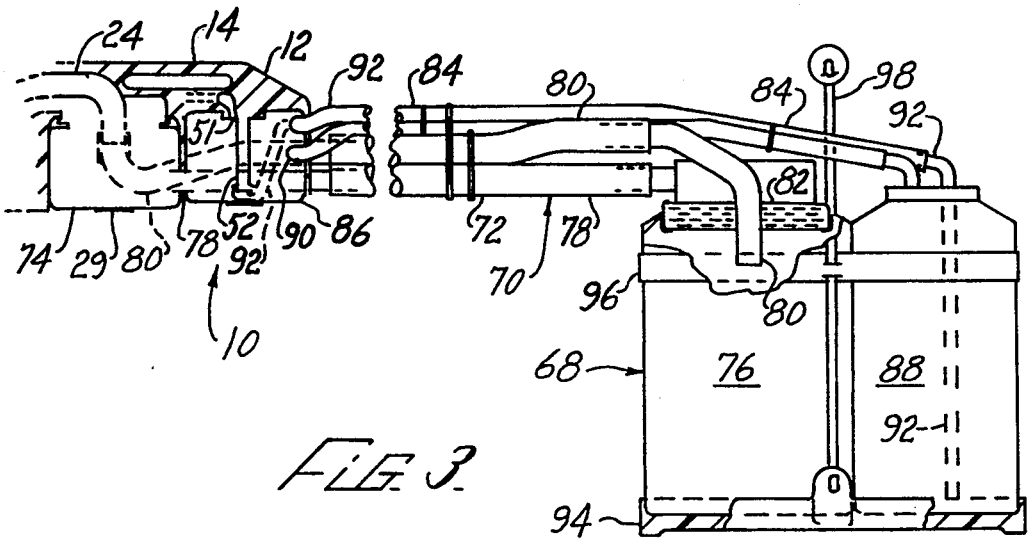
FIG. 3 is side elevational view showing an alternative configuration of the apparatus of FIG. 1.

With further reference to FIG. 3, an alternative configuration of the cleaning apparatus 10 includes a remotely located auxiliary tank unit 68 that is coupled by an extension conduit assembly 70 for augmenting or supplanting the collection tank 28 and/or the solution tank 48. In an exemplary implementation of the apparatus 10 having the tank unit 68, the conduit assembly 70 includes a first conduit pair 72 extending from a collection coupler 74 that replaces the collection tank 28, the first conduit pair 72 being fluid connected to an auxiliary collection tank 76 of the tank unit 68. More particularly, the collection coupler 74 sealingly fluid connects a vacuum extension passage 78 of the first conduit pair 72 to the vacuum passage 32 and sealingly fluid connects a suction extension passage 80 of the first conduit pair 72 to the suction passage 24. The vacuum extension passage 78 is connected to an auxiliary separator 82 that is sealingly supported by the auxiliary collection tank 76, the suction extension passage 80 sealingly extending into the auxiliary collection tank 76 through the auxiliary separator 82 for feeding matter from the suction passage 24 into the auxiliary collection tank 76.

As further shown in FIG. 3, the conduit assembly 70 also includes a second conduit pair 84 that extends from a solution coupler 86 that replaces the collection tank 28 to an auxiliary solution tank 88 of the tank unit 68. The solution coupler 86 sealingly fluid connects a pressure extension passage 90 of the second conduit pair 84 to the pressure pump 50 by means of the pressure passage 51. The solution coupler 86 also sealingly fluid connects a feed extension passage 92 of the second conduit pair 84 to the feed line 52. The pressure extension passage 90 is for pressurizing the auxiliary collection tank 76, the feed extension passage 92 extending into the auxiliary solution tank 88 for feeding cleaning solution from the auxiliary solution tank 88 into the feed line 52 to supply the spray nozzles 56 as described above.

The auxiliary tank unit 68 includes a pallet 94 for supporting the auxiliary tanks 76 and 88, the tanks 76 and 88 being retained by a retainer band 96, a carrying handle 98 for the tank unit 68 supportively connecting the pallet 94 and being stabilized by the retainer band 96.

Thus the apparatus 10 of the present invention provides a compact and inexpensive cleaner that selectively dispenses cleaning fluid and vacuums debris and the fluid from carpets and similar surfaces to be cleaned after subjecting the surfaces to selectively oriented brush-agitation. The auxiliary tank unit 68 conveniently extends the cleaning fluid and debris recovery capacities of the apparatus 10 for facilitating completion of larger cleaning tasks.

Although the present invention has been described in considerable detail with reference to certain preferred versions thereof, other versions are possible. For example, the brush member 40 can be a disk that forms a permanent part of the apparatus 10 for receiving replaceable brushes. Also, the vacuum pump 34 can be fluid connected between the suction passage 24 and the collection tank 28. Similarly, the pressure pump 50 can be fluid connected between the feed line 52 and the dispenser hoses 54. Alternatively, the solution tank 48 can be pressurized by exhaust from the vacuum pump 34. Further, the pump motor 36 can be combined with the drive motor 38, the brush member 40 being driven through a clutch that is controlled by the control switch 66. Moreover, the brush member 40 can be continuously driven. Therefore, the spirit and scope of the appended claims should not necessarily be limited to the description of the preferred versions contained herein.

What is claimed is:

1. A portable cleaner apparatus for cleaning a workpiece surface, the apparatus comprising:

(a) a housing having a nozzle extremity, a suction opening being formed at the nozzle extremity and a suction passage extending within the housing and terminating at the suction opening;

(b) a motor drive supported by the housing;

(c) a brush member rotatably supported relative to the housing on a brush axis and operatively coupled to the motor drive, the brush member extending on the brush axis in a direction away from the housing beyond the nozzle extremity for selective engagement of desired circumferential portions of the brush member with the workpiece surface;

(d) a vacuum pump fluid connected to the suction passage for drawing unwanted material into the suction passage through the suction opening;

(e) supply means for holding a cleaning fluid;

(f) at least one fluid delivery passage for the cleaning fluid, the delivery passage being supported by the housing and having a fluid outlet proximate the suction opening;

(g) a pressure pump fluid connected to the supply means for selectively feeding the cleaning fluid through the delivery passage and from the fluid outlet; and (h) collector means for receiving the unwanted material from the suction passage.

2. The apparatus of claim 1, wherein the supply means comprises a supply passage fluid connected to the delivery passage, and a supply support for releasably holding a supply container fluid connected to the supply passage, the cleaning fluid being delivered through the supply passage to the delivery passage.

3. The apparatus of claim 2, further comprising the supply container.

4. The apparatus of claim 1, wherein the collector means comprises a receiver passage connected to the suction passage, a receiver support for releasably supporting a receiver container fluid connected to the receiver passage for receiving the unwanted material, means for fluid connecting the vacuum pump to the receiver container, and a separator for preventing the unwanted material from passing to the vacuum pump from the receiver passage.

5. The apparatus of claim 4, further comprising the receiver container.

6. The apparatus of claim 1, further comprising a flexible power cord for connecting to a vehicle electrical power outlet for powering the motor drive.

7. The apparatus of claim 1, further comprising a handle member rigidly supported relative to the housing for manually manipulating the apparatus.

8. The apparatus of claim 1, further comprising a feed control for selectively feeding the cleaning fluid.

9. The apparatus of claim 1, further comprising a brush control for selectively activating rotation of the brush member.

10. A portable cleaner apparatus for cleaning a workpiece surface, the apparatus comprising:

(a) a housing having a nozzle extremity, a suction opening being formed at the nozzle extremity and a suction passage extending within the housing and terminating at the suction opening;

(b) a motor drive supported by the housing;

(c) a brush member rotatably supported relative to the housing on a brush axis and operatively coupled to the motor drive, the brush member extending on the brush axis in a direction away from the housing beyond the nozzle extremity for selective engagement of desired circumferential portions of the brush member with the workpiece surface;

(d) a vacuum pump fluid connected to the suction passage for drawing unwanted material into the suction passage through the suction opening;

(e) supply means for holding a cleaning fluid, the supply means comprising a supply container, a supply passage, and a supply support for releasably holding the supply container fluid connected to the supply passage;

(f) at least one fluid delivery passage fluid connected to the supply passage for the cleaning fluid, the delivery passage being supported by the housing and having a fluid outlet proximate the suction opening, the cleaning fluid being delivered through the supply passage to the delivery passage;

(g) a pressure pump fluid connected to the supply means for selectively feeding the cleaning fluid through the delivery passage and from the fluid outlet; and (h) collector means for receiving the unwanted material from the suction passage, the collector means comprising:

(i) a receiver passage connected to the suction passage;

(ii) a receiver support for releasably supporting a receiver container, the receiver container being fluid connected to the receiver passage for receiving the unwanted material;

(iii) means for fluid connecting the vacuum pump to the receiver container; and (iv) a separator for preventing the unwanted material from passing to the vacuum pump from the receiver passage;

(i) a handle member rigidly supported relative to the housing for manually manipulating the apparatus; and (j) a feed control for selectively feeding the cleaning fluid.

* * * * *